United States Patent [19]

Bosser et al.

[11] 4,224,968

[45] Sep. 30, 1980

[54] TANK FILLING INSTALLATIONS

[75] Inventors: Stephane Bosser, Le Plessis Bouchard; Pierre Heitz, Puteaux, both of France

[73] Assignee: Compagnie d'Etudes et de Realisations de Cybernetique Industrielle, Fontenay-sous-Bois, France

[21] Appl. No.: 967,732

[22] Filed: Dec. 8, 1978

[51] Int. Cl.[3] ..... B67C 3/34

[52] U.S. Cl. ..... 141/284; 141/232; 141/374; 193/3; 222/533; 414/373

[58] Field of Search ..... 73/294; 137/590, 615; 141/231, 232, 233, 279, 284, 374, 392; 193/3, 17; 222/533, 536; 414/328, 373

[56] References Cited

U.S. PATENT DOCUMENTS

| | | | |
|---|---|---|---|
| 3,872,899 | 3/1975 | Knight | 141/279 |
| 4,141,394 | 2/1979 | Lassman | 141/284 |

*Primary Examiner*—Frederick R. Schmidt

*Attorney, Agent, or Firm*—Haseltine, Lake & Waters

[57] ABSTRACT

In an automatic tank filling installation, the duct for insertion in the filling orifice of the tank, e.g. mounted on a railway truck or road vehicle, is mounted for movement in the longitudinal direction of movement of the truck or vehicle, for movement in a direction transverse thereto and for pivotal movement about an axis parallel to the longitudinal direction to allow the axis of the pipe to be aligned with the axis of an off center filling orifice, means being provided for causing the pipe to pivot simultaneously with, and as a function of, movement of the pipe in the transverse direction.

9 Claims, 5 Drawing Figures

TANK FILLING INSTALLATIONS

FIELD OF THE INVENTION

The invention relates to improvements in an installation for filling tanks on railway trucks or road vehicles, the installation being of use, inter alia, in hydrocarbon refineries.

BACKGROUND

Automatic tank filling installations used in refineries normally comprise a frame overhanging a track along which tanks move one after another. A duct, which is generally telescopic, is mounted on the frame and can be vertically moved along its axis to enable it to be inserted into a filling orifice in a tank in position below the frame. Since it is not easy to position the tank accurately under the installation, the filling duct is often mounted on a slide which is movable on the frame in the longitudinal direction of the track, so that the duct can be aligned with the orifice.

This longitudinal positioning facility may be insufficient, because the orifice may not be exactly along the tank axis because, after a while, the orifice may become offset, for example, due to improper mounting on the frame, or sagging of the suspension.

To obviate this disadvantage, the tanks are monitored and those which are out of line beyond a certain limit are removed for repairs. Of course, this operation is expensive and it is desirable to increase the out-of-line tolerance threshold so that the tanks can be used longer before repairs.

To accommodate the lack of alignment of the orifices, it has already been proposed to mount the slide bearing the duct so that it can move not only longitudinally but also transversely, so that the duct can be brought exactly above the center of the orifice.

Usually, however, it is found that the displacement of the tank results in an inclination of the tank and therefore of the axis of the orifice. For this reason it may be insufficient to move the duct transversely to bring it above the orifice, because, with the axis of the orifice inclined to the vertical, the horizontal section of the orifice is reduced in the transverse direction, particularly since the tank inlet defining the orifice has a lateral wall which has an appreciable height. Consequently, unless there is a considerable clearance between the duct and the lateral walls of the orifice, the duct will not be able to penetrate into the orifice even after being moved transversely into alignment therewith. Consequently a further reduction has to be made in the permitted lack of alignment of the orifice. For tanks on railway tracks, if the duct has to be lowered into the tank orifice to find out whether it can penetrate into it, and it is then found that the duct will not penetrate into the orifice, the truck will then have to be detached and removed from the train, which of course is very laborious and wastes considerable time.

SUMMARY OF THE INVENTION

It is an object of the invention to provide a tank filling installation comprising;

a frame to be arranged over a track along which tanks will move one after the other;

a bearing slide;

a duct for insertion in an orifice in a tank by moving said duct vertically along its axis;

means for mounting said duct on said slide for pivotal movement about an axis substantially parallel to the longitudinal direction of said track;

means mounting said slide on said frame for movement relative thereto in said longitudinal direction of said track and in a transverse direction for positioning said duct above the filling orifice of a tank; and means for rotating said duct about said pivot axis so as to incline said duct to the vertical at the same time as, and as a function of, the transverse motion thereof so as to align said axis of said duct with the axis of the filling orifice of a tank.

In a preferred embodiment of the invention, said duct rotating means comprises a lever keyed to a pivot of said duct mounting means, said lever extending parallel to said axis of said duct, one end of said lever being in engagement with a cam provided on a part of said frame extending parallel to said transverse direction of motion of said slide, said cam comprising an inclined surface extending on either side of a central position at which said duct and said lever are vertical, said cam surfaces engaging said one end of said lever so as to incline said lever and said duct when said slide moves transversely away from said central position.

The invention will now be described with reference to embodiments thereof, given by way of example only, with reference to the accompanying drawings.

DETAILED DESCRIPTION

Figure 1:
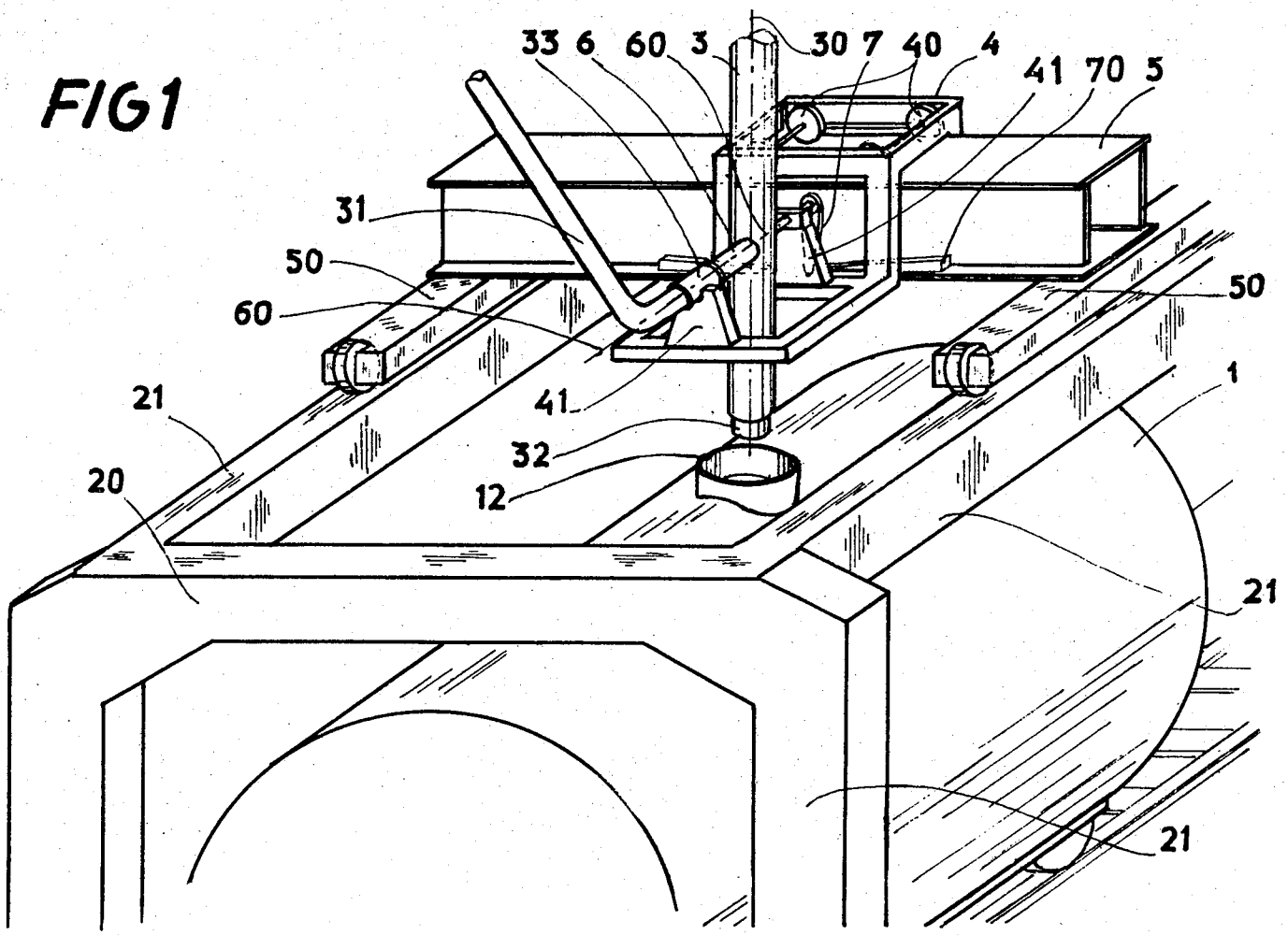
FIG. 1 is a diagrammatic perspective view of an embodiment of a filling installation according to the invention.
Figure 2:
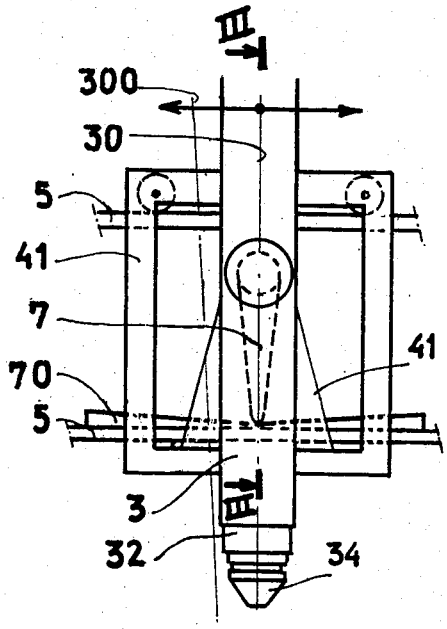
FIG. 2 is a diagrammatic elevational view of the installation of FIG. 1, as seen perpendicular to the track axis.
Figure 2:
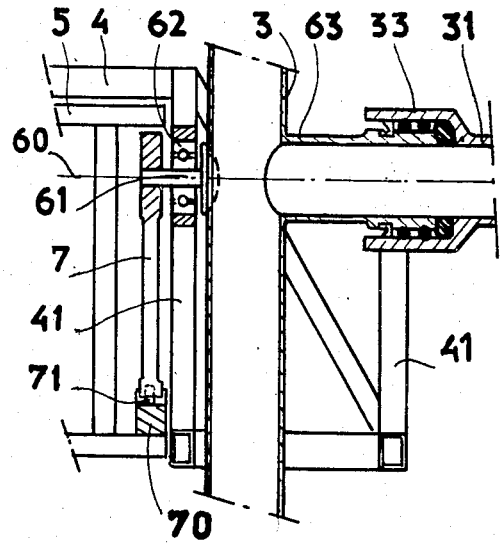
Figure 3:
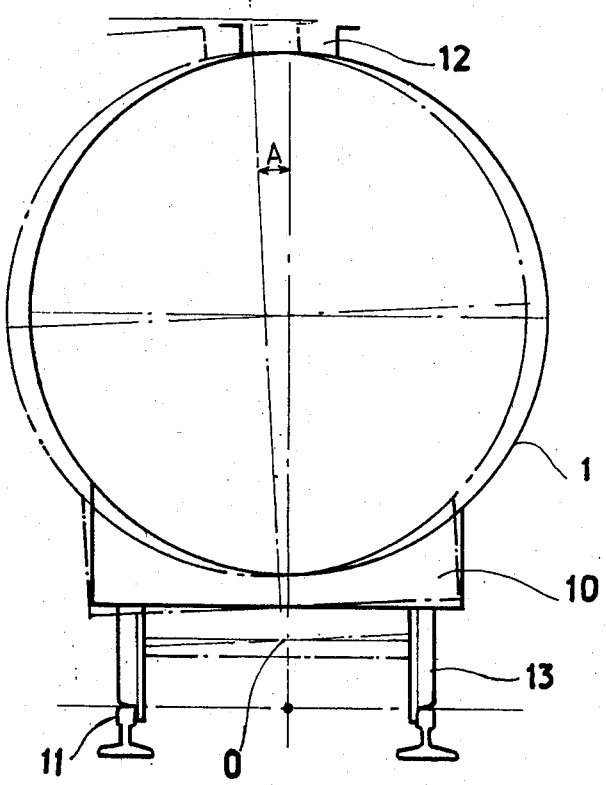
FIG. 3 is a partial view in longitudinal section along the line III—III in FIG. 2.

FIGS. 1 to 3 shows diagrammatically an installation for filling tanks 1 which are adapted to move one behind the other along a track 11. The installation comprises a frame comprising e.g. gantries 20 bridging the track 11 and connected by longitudinal beams 21 along which a filling duct 3 is movable.

The duct 3 is movable with respect to the frame 2 in the longitudinal direction of track 11 and also in the transverse direction, so that an operator can accurately position it above the filling orifice 12 of the tank 1. To this end, duct 3 is supported by a slide 4 which is movable along a transverse girder 5 which is supported at its ends by bearing members 50 which are longitudinally movable along roller tracks formed on beams 21.

Side 4 is movable along girder 5, and girder 5 is movable along beams 21, on conventional roller bearing means which have not been shown in detail.

Duct 3 is mounted on slide 4 by pivots 6 for pivotal movement about a pivoting axis 60 parallel to the longitudinal axis of track 11. Pivots 6 bear via bearings on seat 41 formed on slide 4.

Duct 3 can be of any known kind which is adapted to be lowered into tank 1 by sliding along its axis 30. The duct 3 is connected to a pipe system for filling the tank with fluid. Advantageously, duct 3 comprises one or more tubes slidably mounted in telescopic manner in a stationary tube by which the assembly is held by the slide. Accordingly, FIG. 1 shows a stationary tube 3 to which the bearing pivots 6 are secured, and a movable tube 32 adapted to be lowered vertically by means, such as, a winch or jack. The movable tube 32 may inter alia be made up of a plurality of telescopic components.

Since the installation is movable, a supply pipe system 31 must be able to follow the movement of the duct 3. This can be done by conventional means, but it is particularly advantageous if, as shown, one pivot 63 is hollow and forms a tube supplying fluid to duct 3, the tube being connected to pipe system 31 by a rotating seal 33 forming one of the bearings on which the pivot rotates.

It may happen that, after a time, the axis of the filling orifice 12 of the tank is no longer vertical. This generally results from sagging of the frame suspension 10 or motion of the tank on its frame. In practice, the movement can be compared with rotation through an angle A around a center approximately level with the axis of the truck axle 13.

The duct 3 is then rotated about the axis of pivots 6 to give it an inclination proportional to its transverse motion, so that the duct axis 30 is inclined in the direction 300 extending through the center 0 relative to which the tank is moved out of alignment, so that the axis of the duct coincides with the axis of orifice 12 and ensures that the duct will penetrate smoothly into the tank.

Preferably, the pivots 6 are placed so that the duct is balanced with respect to the pivot axis 60, so that only a slight force is necessary to incline the duct and hold it in position. The balance is not very difficult to obtain, since the top part of tube 6 often bears a relatively heavy installation such as a jack for controlling the descent of the duct, and this installation can balance the weight of the telescopic duct 32 if the position of pivot axis 60 is well chosen.

In the embodiment shown in the drawings, the duct inclination is controlled by a lever 7 keyed to a duct pivot 61 and extending downwards parallel to axis 30. The end of lever 7 is in contact with a cam 70 secured to the transverse girder 5 and providing two inclined cam surfaces extending in a direction parallel to the transverse direction of motion of the duct on either side of the central position, at which the duct is vertical.

Preferably, a roller 71 is placed at the end of lever 7 to roll on the cam surfaces of cam 70. The inclination of the cam surfaces can be fairly easily calculated so that, as shown in FIG. 2, axis 30 parallel to lever 7 extends through point 0 when the pivot axis 60 is moved to either side of the central position.

FIG. 3 shows the transverse girder 5 and the slide 4, with the two seats 41 supporting the pivot 6. One pivot 61 bears on the corresponding seat 41 via a bearing 62. The other pivot 63 is a hollow cylinder connected to the pipe system 31 supplying fluid to duct 3 by the rotating joint or bearing 33 which rests on the corresponding seat 41.

The position of point 0 (FIG. 2) can be determined by a statistical study of the transverse off-centering of the tanks. If, as a result of the off-centering, the axis of orifice 12 does not extend through a single point, a statistical study can be made to determine the inclination A of the orifice axis in dependence on the amount of transverse shift, so that cam 70 can be given the desired shape empirically to ensure that the duct is given the desired inclination by moving the slide transversely using the lever.

Of course, other equivalent means could be used to incline the duct by moving it transversely. For example, the duct inclination could be controlled by a rotary jack e.g. an ordinary hydraulic motor, controlled in accordance with the transverse motion of the pivot axis, in accordance with a function chosen so that the transverse movement provides the desired inclination.

Figure 4:
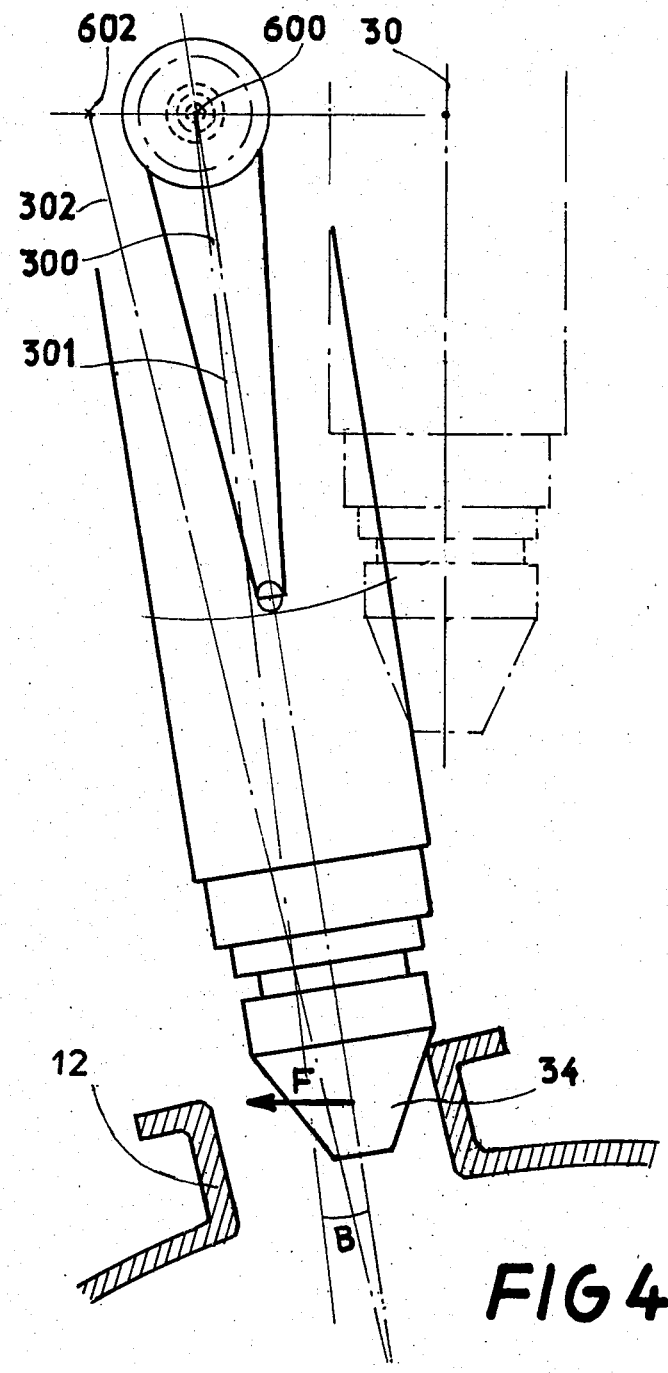
FIG. 4 shows a duct, in an inclined position, of another embodiment.
Figure 5:
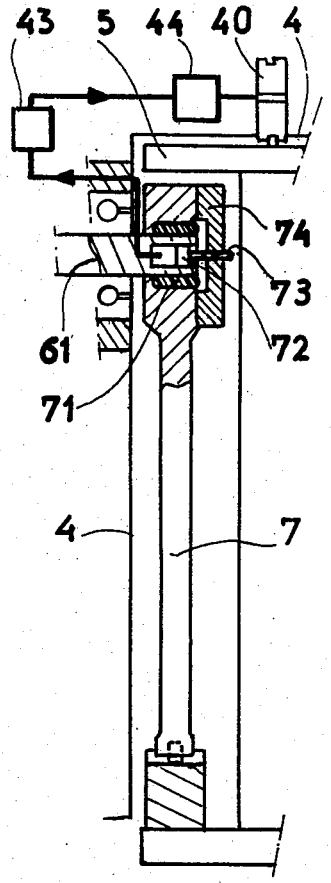
FIG. 5 is a detailed view of part of the embodiment of FIG. 4.

However, in spite of precautions, it may happen that the duct is not immediately given a desired inclination so as to penetrate easily into the orifice. This may happen if the operator positioning the duct is not sufficiently aware of the transverse motion which the slide has to be given. For this reason, in an improved embodiment, the installation comprises a device for automatically compensating errors in inclination whereby, after a first test has shown that the end of the duct does not extend directly into the orifice, the lateral force produced by the end of the duct bearing on the edge of the orifice is detected and, via a control system, is converted into an additional transverse motion of the slide modifying the inclination of the duct until the force with which it bears against the edge of the orifice has been eliminated. A device of this kind is shown diagrammatically in FIGS. 4 and 5.

It is assumed that the operator, after first trying to lower the duct vertically, has found that it does not enter the orifice and accordingly moves the slide transversely so as to incline the duct so as to bring it into the axis of the orifice. The duct is then in the inclined position shown in FIG. 4, its axis extending in direction 300, and it can be seen that its end strikes the edge of orifice 12. Usually the duct is terminated by a fluid-distributing nozzle 34 so that when the nozzle presses against the edge of orifice 12, a lateral force F is exerted on the end of the duct. This force tends to rotate the duct around the pivots through an angle B, so that its axis is in the direction 301.

Since lever 7 is locked, the duct can rotate only if it can move angularly relative to the lever 7. This is made possible by mounting lever 7 on pivot 61 in an improved manner, shown in FIG. 5. Lever 7 is connected to pivot 61 by a resilient connection comprising a rubber ring 71, the inner surface of which is secured to pivot 61 whereas its outer surface is secured to the wall of a bore formed on the lever so that pivot 61 can extend through it. The lever 7 is centered on the pivot so that ring 71 will allow the lever 7 to rotate through a small angle relative to the duct, without the lever coming out of alignment. However, the characteristics of ring 71 are designed so that the angular movement will occur only above a certain threshold torque applied by the lever to the pivot, the threshold being higher than the torque necessary for inclining the duct. As we have seen, the duct can be well balanced around its pivot axis 600, so that the inclining force is relatively low. It is thus possible to use a resilient seal, so that the lever can be used to rotate the duct without relative angular movement when the duct is free. On the other hand, if the end of the duct bears on orifice 12, the resulting lateral force may deform the resilient connection 71, since the lever arm is equal to the distance between the orifice and the pivot axis.

The angular movement can be measured by a pick-up comprising a body 72 placed in an axial bore in pivot 61 and keyed thereto, the associated measuring device being driven by a shaft 73 which, via a connecting component 74, rotates with lever 7.

Thus, when the nozzle 34 bearing on the edge of orifice 12 produces a lateral force which angularly moves the duct, the angle of rotation B of the duct axis relative to the axis of lever 7 is detected by pick-up 72, which transmits a signal corresponding in magnitude and sign to the magnitude and direction of angle B. The signal is interpreted by a conventional regulating system 43 which, via electronic or hydraulic means, automatically triggers a slide moving motor 44 to move the slide 4 and consequently move the duct axis in the direction of the force applied by the duct, so that the force is counteracted. Consequently, as long as a force F is exerted on the duct nozzle 34, slide 4 moves the pivot axis in the same direction as the force, until the nozzle no longer bears on orifice 12. The motion of the pivot axis to position 602 results in the duct being further inclined from direction 300 to direction 302, at which it can enter the tank without bearing against orifice 12.

The slide can be moved in any known manner, by electronic or hydraulic means. It can be moved either stepwise, i.e. by successive units, or in proportion to the displacement angle B. An empirical correlation can be established between (a) the angle B through which the axis 300 of the inclined duct is altered by pressure on orifice 12 and (b) the angle C between axis 300 and its theoretical direction 302, in dependence on the duct characteristics and inter alia on the resilient connection between the lever and pivot.

Of course the invention is not intended to be limited to the details of the aforementioned embodiments, but includes all variants, inter alia those differing only in the use of equivalent means.

We claim:

1. A tank-filling installation comprising:

a frame to be arranged over a track along which tanks will move one after the other;

a bearing slide;

a duct for insertion in an orifice in a tank by moving said duct along its axis; said orifice being capable of having an axis inclined with respect to the vertical;

means mounting said duct on said slide for pivotal movement about an axis substantially parallel to the longitudinal direction of said track;

means mounting said slide on said frame for movement relative thereto in said longitudinal direction of said track and in a transverse direction for positioning said duct above the filling orifice of a tank; and means for rotating said duct about said pivot axis so as to incline said duct with respect to the vertical at the same time as, and as a function of, the transverse motion thereof, said rotating means producing correlated pivotal and transverse movement of said duct so as to align said axis of said duct with the axis of the filling orifice of the tank.

2. An installation according to claim 1, wherein said duct rotating means comprises a lever keyed to a pivot of said duct mounting means, said lever extending parallel to said axis of said duct, one end of said lever being in engagement with a cam provided on a part of said frame extending parallel to said transverse direction of motion of said slide, said cam comprising an inclined surface extending on either side of a central position at which said duct and said lever are vertical, said cam surfaces engaging said one end of said lever so as to incline said lever and said duct when said slide moves transversely away from said central position.

3. A filling installation according to claim 1, wherein a pivot of said duct mounting means is hollow and forms a lateral pipe for supplying fluid to said duct, said pipe being connected to a fluid supply circuit by a rotatable seal forming a bearing for said hollow pivot.

4. A filling installation according to claim 2, comprising means for automatically compensating errors in inclination of said duct and comprising means for detecting a lateral force with which the end of said duct bears on the edge of the filling orifice of a tank, and means for moving said slide transversely in the direction in which said force is applied to said duct until said force is eliminated, said moving means being controlled by said detecting means.

5. An installation according to claim 4, wherein said lateral force detecting means comprises means for resiliently connecting said lever to said duct pivot so as to enable said lever to rotate relative to said pivot when the torque applied to said pivot exceeds a preset threshold, and means for indicating the angular offset between said duct and said lever resulting from said lateral force.

6. An installation according to claim 5, wherein said resilient connecting means comprises a resiliently elastic ring provided on said pivot, the inner surface of said ring being secured to said pivot and the outer surface of said ring being secured to said lever.

7. An installation according to claim 5, including a regulating system for controlling said moving means, said regulating system being connected to receive a signal indicating the angular offset between said duct and said lever and being adapted to supply to said moving means an order to move said slide in the direction for counteracting said angular offset.

8. An installation according to claim 1 wherein said rotating means produces such correlated pivotal and transverse movement of said duct that said axis of said duct passes through a common point remote from said duct.

9. A filling installation according to claim 1, comprising means for automatically compensating errors in inclination of said duct and comprising means for detecting a lateral force with which the end of said duct bears on the edge of the filling orifice of a tank, and means for moving said slide transversely in the direction in which said force is applied to said duct until said force is eliminated, said moving means being controlled by said detecting means.

* * * * *